US008104888B2

(12) United States Patent
Sugimoto et al.

(10) Patent No.: US 8,104,888 B2
(45) Date of Patent: Jan. 31, 2012

(54) INKJET RECORDING APPARATUS

(75) Inventors: Kiyoshi Sugimoto, Kuwana (JP); Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 508 days.

(21) Appl. No.: 12/343,001

(22) Filed: Dec. 23, 2008

(65) Prior Publication Data

US 2009/0167814 A1 Jul. 2, 2009

(30) Foreign Application Priority Data

Dec. 26, 2007 (JP) ..... 2007-333940

(51) Int. Cl.
*B41J 2/01* (2006.01)

(52) U.S. Cl. ..... 347/104; 347/20; 347/22; 347/29; 347/30; 347/32; 347/101

(58) Field of Classification Search ..... 347/101, 347/104

See application file for complete search history.

(56) References Cited

U.S. PATENT DOCUMENTS 5,557,387 A * 9/1996 Hatano ..... 399/381
5,717,446 A * 2/1998 Teumer et al. ..... 347/35
5,836,582 A * 11/1998 Ogawa et al. ..... 271/12
6,412,769 B1 * 7/2002 Goda et al. ..... 271/94
6,834,949 B2 * 12/2004 Greive ..... 347/104
7,384,122 B2 * 6/2008 Shimizu ..... 347/34
7,722,180 B2 * 5/2010 Mashima ..... 347/104
2004/0245711 A1 * 12/2004 Domoto et al. ..... 271/197
2007/0035605 A1 2/2007 Kitahara
2007/0222138 A1 * 9/2007 Ikeda ..... 271/11

FOREIGN PATENT DOCUMENTS

JP H08-067095 A 3/1996
JP 2007-008093 A 1/2007
WO 2006/054665 A1 5/2006

OTHER PUBLICATIONS

Japan Patent Office, Notice of Reasons for Rejection for Japanese Patent Application No. 2007-333940 (counterpart to above-captioned patent application), mailed Jun. 28, 2011.

* cited by examiner

*Primary Examiner* — Ryan Lepisto
(74) *Attorney, Agent, or Firm* — Baker Botts L.L.P.

(57) ABSTRACT

A recording apparatus includes: a conveyor which has one or more holes penetrating from a first surface to a second surface thereof, and which conveys, in a conveyance direction, a recording medium supported on the first surface; and a recording unit which is at such a position as to face the first surface, and records an image on a recording medium while the recording medium is conveyed by the conveyor. The recording apparatus further includes an exhauster capable of causing air exhaust through the one or more holes so that airstream in the one or more holes is directed from the second surface to the first surface; and a controller which controls the exhauster so as to cause air exhaust through at least one medium-facing hole out of the one or more holes, the medium facing hole being a hole facing a recording medium.

20 Claims, 7 Drawing Sheets

INKJET RECORDING APPARATUS

The present application claims priority from Japanese Patent Application No. 2007-333940, which was filed on Dec. 26, 2007, the disclosure of which is herein incorporated by reference in its entirety.

BACKGROUND OF THE INVENTION

1. Field of the Invention

The present invention relates to a recording apparatus which records an image on a recording medium.

2. Description of Related Art

Japanese Unexamined Patent Publication 2007-8093 discloses a full-line inkjet printer including a full-line print head which ejects ink, and a sheet conveying unit which conveys a sheet to a position where the sheet faces the full-line print head. In the full-line inkjet printer, the sheet conveying unit includes a conveyor belt having suction holes formed thereon, a platen which supports the conveyor belt and has ventilation holes, and an absorption fan unit which absorbs air through the suction holes and the ventilation holes. In this structure, the sheet conveying unit conveys a sheet to a position where the sheet faces the full-line print head, while sucking air with the absorption fan unit to absorb the sheet onto the conveyor belt.

SUMMARY OF THE INVENTION

However, according to the full-line inkjet printer of the above Patent Document, when, for instance, a sheet jams between the full-line print head and the conveyor belt and thus the sheet stops at the position facing the full-line print head, the sheet remains adhered to the conveyor belt even though the absorption fan unit stops absorbing the sheet. This gives a user a difficulty in removing the jammed sheet from the conveyor belt.

Thus, the object of the invention is to provide a recording apparatus which allows easy removal of a recording medium.

A recording apparatus of the present invention includes: a conveyer which has one or more holes penetrating from a first surface to a second surface thereof and which conveyer conveys, in a conveyance direction, a recording medium supported on the first surface; a recording unit which is at such a position as to face the first surface and which recording unit records an image on a recording medium while the recording medium is conveyed by the conveyer; an exhauster capable of causing air exhaust through the one or more holes so that airstream in the one or more holes is directed from the second surface to the first surface; and a controller which controls the exhauster so as to cause air exhaust through at least one medium-facing hole out of the one or more holes, the medium-facing hole being a hole facing a recording medium.

According to the structure, air is exhausted through at least one medium-facing hole facing a recording medium, causing the recording medium to be lifted from a first surface. Thus, the recording medium is easily peeled from the first surface. This allows easy removal of the recording medium.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
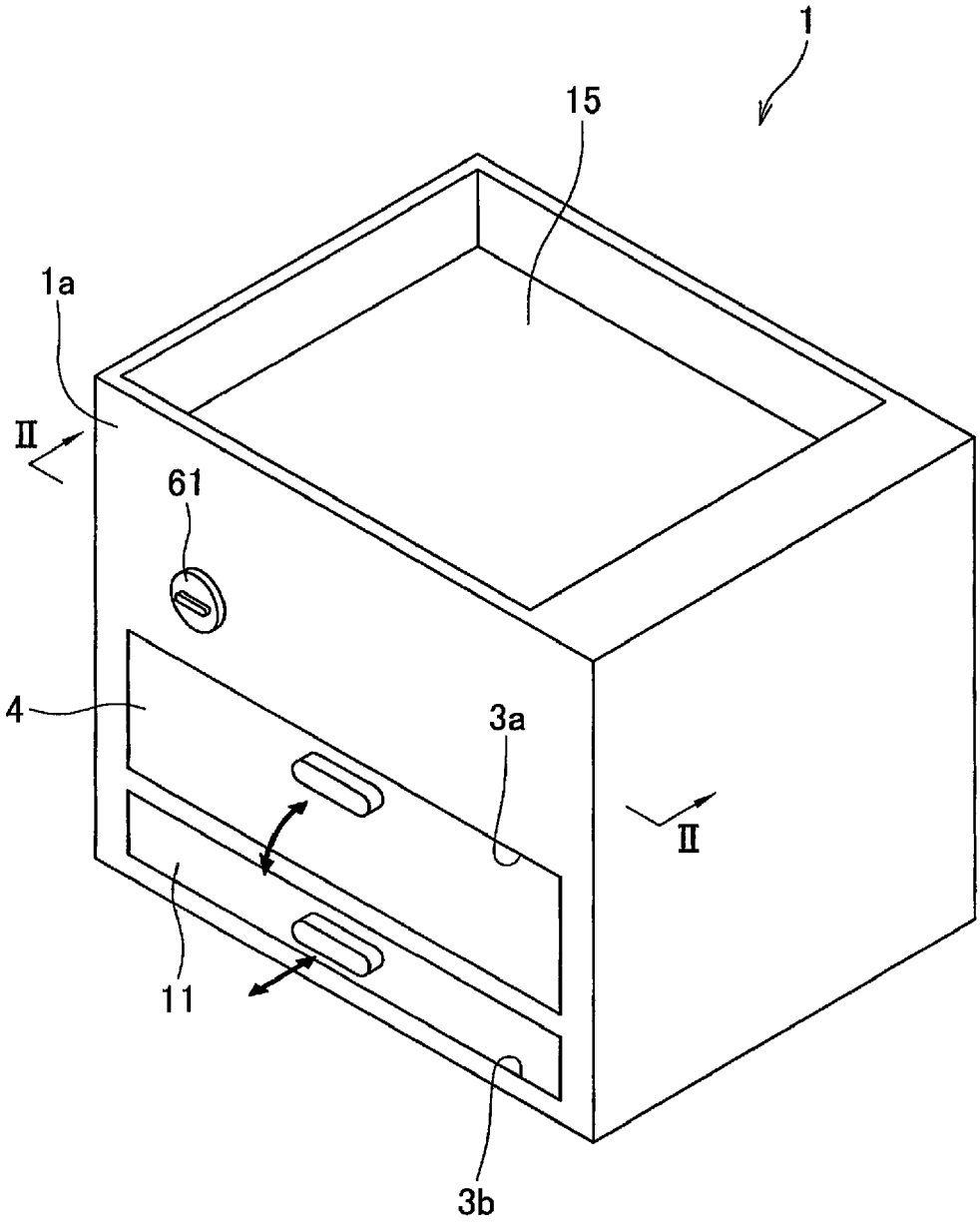
FIG. 1 is a perspective view of an exterior view of an inkjet printer according to a first embodiment of the present invention.

As illustrated in FIG. 1, an inkjet printer 1 of the first embodiment of the present invention has a rectangular parallelepiped shaped housing 1*a*. On a front surface of the housing 1*a*; i.e., the surface on the left side of FIG. 1 facing the viewer, the following members are provided in this order from the top of the housing 1*a*: a rotation member 61, an opening 3*a*, a door 4, and an opening 3*b*. The rotation member 61 rotates in response to an operation by a user. The door 4 fits into the opening 3*a*, and is capable of opening and closing about a horizontal axis at its lower end. A sheet feed cassette 11 can be inserted into the opening 3*b*. The opening 3*a* and the door 4 are positioned so as to face a belt conveyor 50 in a depth direction of the housing 1*a*; i.e., a direction orthogonal to the surface of FIG. 2 and perpendicular to a conveyance direction A.

Figure 2:
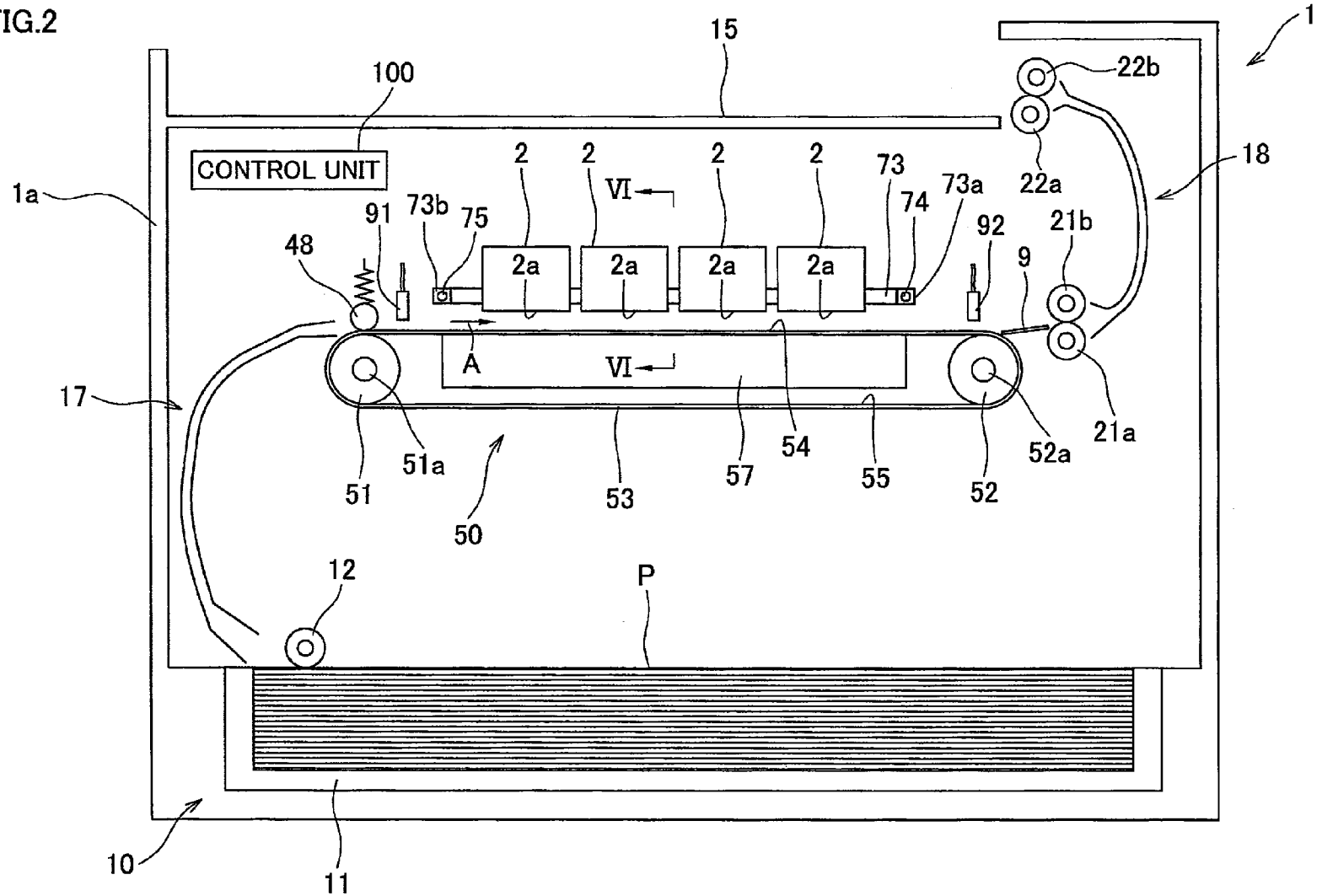
FIG. 2 is a schematic side view of an internal structure of the inkjet printer of FIG. 1.

The inkjet printer 1 is a color inkjet printer having four inkjet heads 2 which respectively eject different colors of ink, magenta, cyan, yellow, and black, as illustrated in FIG. 2. The printer 1 is provided with a sheet feed unit 10 and a sheet discharge unit 15 in lower and upper parts of FIG. 2, respectively. Between the sheet feed unit 10 and the sheet discharge unit 15 is the belt conveyor 50. The printer 1 is further provided with a control unit 100 for controlling operations of these members.

As illustrated in FIG. 2, the sheet feed unit 10 includes: a sheet feed cassette 11 capable of storing therein a plurality of piled sheets P; a pickup roller 12 which sends out a sheet P from the sheet feed cassette 11; and a sheet feeding motor 13 (see FIG. 5) which rotates the pickup roller 12. The sheet feed cassette 11 is attachable/detachable to/from the housing 1*a* in the direction orthogonal to the surface of FIG. 2. The sheet feed cassette 11 overlaps with the belt conveyor 50 in the up/down direction in FIG. 2 when attached to the housing 1*a*.

The pickup roller 12 rotates, contacting the uppermost one of the sheets P stored in the sheet feed cassette 11 to send out the sheet P. The sheet feeding motor 13 is controlled by the control unit 100. Near the end of the sheet feed cassette 11 in the left end of FIG. 2 is a conveyance guide 17 curved and extending from the sheet feed cassette 11 towards the belt conveyor 50.

In this structure, the pickup roller 12 rotates clockwise in FIG. 2 under control of the control unit 100, to send out a sheet P contacting the pickup roller 12 to the belt conveyor 50, passing through the conveyance guide 17.

Figure 3:
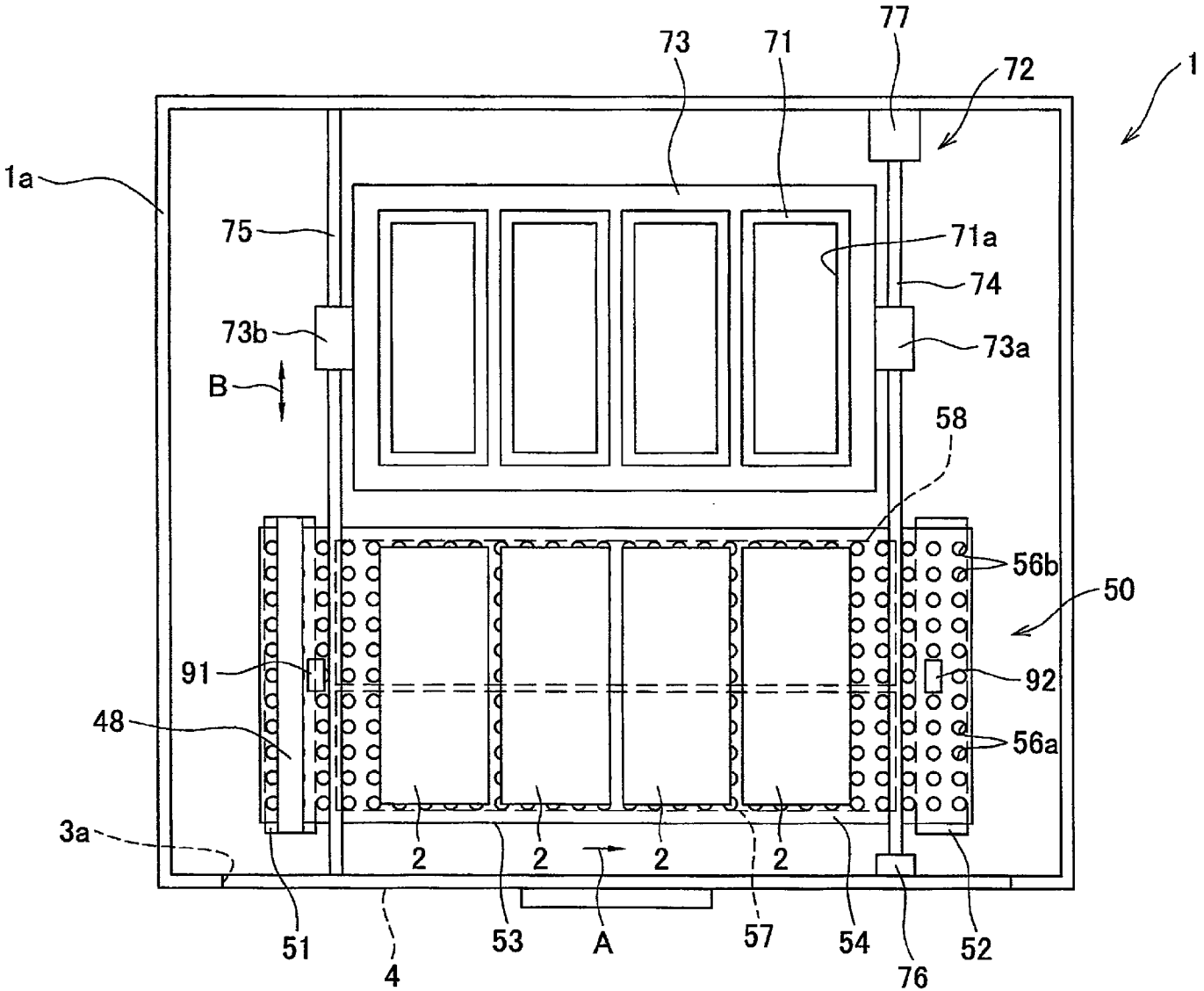
FIG. 3 is a schematic plan view of an internal structure of the inkjet printer of FIG. 1.

The belt conveyor 50 includes a pair of belt rollers 51 and 52, an endless conveyor belt 53 looped around the belt rollers 51 and 52, and a conveying motor 59 (see FIG. 5) which applies drive power to rotate the belt roller 52. The belt conveyor 50 conveys a sheet Pin a conveyance direction A; i.e., the direction indicated by arrow A in FIG. 2. The conveyor belt 53 has a plurality of holes 56*a* and 56*b* penetrating in a thickness direction from a conveyor face 54 to an inner circumferential surface 55, as illustrated in FIG. 3. The conveyor surface 54 of the conveyor belt 53, or an outer circumferential surface, is also referred to as a first surface. The inner circumferential surface 55 of the conveyor belt 53 is also referred to as a second surface. These holes 56*a* and 56*b* are scattered on the entire conveyor belt 53. As described below, the belt roller 51 is capable of moving downward towards the sheet feed cassette 11.

A press roller 48 is provided at a position facing the belt roller 51, and more upstream than the most upstream inkjet head 2 in the conveyance direction A. The press roller 48 presses, on the conveyor surface 54, a sheet P having been sent out from the sheet feed unit 10. The press roller 48 is biased by an elastic member such as a spring to the conveyor surface 54. The press roller 48, which is a driven roller, rotates as the conveyor belt 53 rotates.

Provided in the area enclosed with the conveyor belt 53 and facing the four inkjet heads 2 are two fans 57 and 58 each having a substantially rectangular parallelepiped shape. As illustrated in FIG. 3, the two fans 57 and 58 are adjacent to each other in a direction B (up/down direction in FIG. 3) perpendicular to the conveyance direction A. The fan 57 is closer to the door 4 than the fan 58 is.

Further, the two fans 57 and 58 are fixed to a not-illustrated support member supported by a shaft 51*a* of the belt roller 51 and a shaft 52*a* of the belt roller 52. The support member swings about the shaft 52*a* of the belt roller 52 as the belt roller 51 moves. This enables the fans 57 and 58 to swing with the support member.

The fan 57 serving as an exhauster has such a structure capable of causing air suction and exhaust through holes 56*a* which are provided between the four inkjet heads 2 and the fan 57, and face the fan 57. During air suction, airstream in the aforementioned holes 56*a* is directed from the conveyor surface 54 to the inner circumferential surface 55. During air exhaust, airstream in the aforementioned holes 56*a* is directed from the inner circumferential surface 55 to the conveyor surface 54. Meanwhile, the fan 58 serving as a suction device has such a structure capable of causing air suction through holes 56*b* which are provided between the four inkjet heads 2 and the fan 58, and face the fan 58. The term "air suction through the holes 56*a*" includes absorbing a sheet P onto the belt 53, when the sheet P is on the conveyor belt 53 and covers the holes 56*a*, by differentiating the pressure between the first surface side and the second surface side of the belt 53 around the holes 56*a*. Likewise, the term "air suction through the holes 56*b*" includes absorbing a sheet P onto the belt 53, when the sheet P is on the belt 53 and covers the holes 56*b*, by differentiating the pressure between the first surface side and the second surface side of the belt 53 around the holes 56*b*.

Among the holes 56*a* and the holes 56*b* formed on the conveyor belt 53, the holes 56*a* are formed on a strip area of the conveyor belt 53, which strip area passes above the fan 57 as the conveyor belt 53 rotates. The holes 56*b* are formed on a strip area of the conveyor belt 53, which strip area passes above the fan 58 as the conveyor belt 53 rotates. The two strip areas where the holes 56*a* and 56*b* are provided respectively are formed throughout the entire length of the conveyor belt 53 in the conveyance direction A, when the conveyor belt 53 is seen from the inkjet head 2, as illustrated in FIG. 3.

The conveying motor 59 and the fan 58 are controlled by the control unit 100. The fan 57 is controlled by the control unit 100 via an impressed voltage controller 28 (see FIG. 5), so as to change the amount of air exhausted through holes 56*a*, according to the type of a sheet P, in order to apply a desired wind pressure to the sheet P. Note that the type of a sheet P is a weight of the sheet P per unit area. The impressed voltage controller 28 is for changing a voltage impressed on the fan 57, and thus is capable of adjusting the amount of air exhausted through holes 56*a*.

In this structure, the control unit 100 controls the belt roller 52 to rotate clockwise in FIG. 2, causing the conveyor belt 53 to rotate. The belt roller 51 and the press roller 48, which are driven rollers, are rotated following the rotation of the conveyor belt 53. When the control unit 100 controls to drive the fans 57 and 58 so as to cause air suction through the holes 56*a* and 56*b* respectively facing the fans 57 and 58, a sheet P sent out from the sheet feed unit 10 is conveyed in the conveyance direction A, while being absorbed onto the conveyance surface 54. Further, when the sheet P is not correctly conveyed for some reason such as a sheet P jams between the inkjet heads 2 and the conveyor surface 54, and thus the conveyance of the sheet P stops, the control unit 100 controls to drive the fan 57 so as to cause air exhaust through the holes 56*a* facing the fan 57, and to drive the fan 58 so as to cause air suction through the holes 56*b* facing the fan 58. This causes a part of the sheet P facing the fan 58 to be absorbed onto the conveyance surface 54, and a part of the sheet P facing the fan 57 to be separated from the conveyance surface 54.

In the vicinity of a downstream end of the belt conveyor 50 in the conveyance direction A is a separation member 9. A leading end of the separation member 9 gets in between the sheet P and the conveyor belt 53 to separate a sheet P from the conveyor surface 54.

A sheet sensor 91 is provided between the most upstream inkjet head 2 in the conveyance direction A and the press roller 48. A sheet sensor 92 is provided in a position more downstream than the most downstream inkjet head 2, and facing the belt roller 52. The sheet sensor 91 detects a leading end of the sheet P whose conveyance has begun by the belt conveyor 50. The sheet sensor 92 detects the leading end of the sheet P having been passed an area facing the inkjet heads 2, while the sheet P is conveyed by the belt conveyor 50. Each of the sheet sensors 91 and 92 transmits a detection signal to the control unit 100 when detecting the leading end of the sheet P.

In the path between the belt conveyor 50 and the sheet discharge unit 15 are: four feed rollers 21*a*, 21*b*, 22*a*, and 22*b*; and a conveyance guide 18 provided between the feed rollers 21*a* and 21*b*, and the feed rollers 22*a* and 22*b*. The feed rollers 21*b* and 22*b* are respectively rotated by feed motors 23 and 24 (see FIG. 5) controlled by the control unit 100. In this structure, the control unit 100 controls the feed motors 23 and 24 so as to respectively rotate the feed rollers 21*b* and 22*b*, causing a sheet P discharged from the belt conveyor 50 to be sandwiched by the feed rollers 21*a* and 21*b* and sent to an upper part of the FIG. 2, passing through the conveyance guide 18. Afterwards, the sheet P is send to the sheet discharger 15 while being sandwiched by the feed rollers 22*a* and 22*b*. Note that the feed rollers 21*a* and 22*a* are driven rollers which rotate as a sheet is conveyed.

The four inkjet heads 2 are aligned in the conveyance direction A as illustrated in FIG. 2 and FIG. 3. In other words, the inkjet printer 1 is a line printer. Each of the inkjet heads 2 has a slender rectangular parallelepiped shape whose longitudinal direction extends in the direction B perpendicular to the conveyance direction A. Further, each of the inkjet heads 2 has a not-illustrated passage unit and a not-illustrated actuator laminated together, which passage unit has an ink passage including a pressure chamber, and which actuator applies pressure to ink inside the pressure chamber. Not-illustrated nozzles formed on the ejection surface 2*a*, which is a bottom surface of the inkjet head 2, eject ink.

The printer 1 is provided with a not-illustrated head-moving mechanism which moves the four inkjet heads 2 in up/down direction in FIG. 2. The head-moving mechanism moves the four inkjet heads 2 between a printing position and a withdrawal position. The printing position is where printing is performed on a sheet P being conveyed on the conveyor belt 53. The withdrawal position is above the printing position, and where later-described caps 71 can be positioned between the ejection surfaces 2*a* and the conveyor surface 54. Note that the head-moving mechanism is controlled by the control unit 100.

When the inkjet heads 2 are positioned at the printing position by the head-moving mechanism, the ejection surfaces 2*a* of the inkjet heads 2 parallel a part of the conveyor surface 54 of the conveyor belt 53, which part faces the inkjet heads 2. Formed between the ejection surfaces 2*a* and the conveyor surface 54 is a sheet conveyance path. According to the structure, ink droplets of the respective colors are ejected from nozzles, which are ejection openings, towards an upper surface of a sheet P serving as a print surface when the sheet P conveyed on the conveyor belt 53 sequentially passes below the four inkjet heads 2. Thus, a desired color image is formed.

Inside the housing 1*a* of the printer 1 are four caps 71 each covering an inkjet head 2, and a cap-moving mechanism 72 serving as a first movement mechanism which causes the four caps 71 to move in the perpendicular direction B, as illustrated in FIG. 3. Each of the caps 71 has a U-shape open towards the ejection surface 2*a*. The opening 71*a* of each of the caps 71 is slightly smaller than the ejection surface 2*a*. The four caps 71 are aligned in the conveyance direction A so as to respectively correspond to the inkjet heads 2.

The cap-moving mechanism 72 includes: a plate support member 73 which supports bottoms of the caps 71; rod-shaped guide members 74 and 75 which support the support member 73; a support unit 76 rotatably supporting one end of the guide member 74; and a drive motor 77 which is connected to the other end of the guide member 74 and rotates the guide member 74. Note that the drive motor 77 is controlled by the control unit 100.

Respectively formed on both ends of the support member 73 in the conveyance direction A are protrusions 73*a* and 73*b* protruding parallel to the conveyance direction A. The protrusion 73*a* has a hole penetrating in the perpendicular direction B. Formed on an inner circumferential surface of the hole is a female screw. Formed on an outer circumferential surface of the guide member 74 is a male screw corresponding to the female screw of the protrusion 73*a*. The guide member 74 penetrates the hole of the protrusion 73*a* with the male screw screwed into the female screw. The protrusion 73*b* also has a hole penetrating in the perpendicular direction B. A guide member 75 slidably penetrates the hole.

In the structure, when the drive motor 77 is driven under control of the control unit 100, the guide member 74 rotates in a predetermined direction, causing the caps 71 to move from the withdrawal position illustrated in FIG. 3 to the capping position. The withdrawal position is where the caps 71 do not face the inkjet heads 2 nor cover the ejection faces 2*a*. The capping position is where the caps 71 face the inkjet heads 2 and cover the ejection surfaces 2*a*. On the other hand, when the guide member 74 rotates in a direction opposite to the predetermined direction under control of the control unit 100, the caps 71 move from the capping position to the withdrawal position.

FIG. 4 is an explanatory diagram describing a movement of a belt roller. Provided to each end of the belt conveyor 50 of the printer 1 in the width direction is a roller-moving mechanism 60 serving as a second movement mechanism, which causes the belt roller 51 to move. The roller moving mechanism 60 has a rotation member 61, a ring 62, a connecting member 63, and a plate 65. The ring 62 is provided near an end of the shaft 51*a* of the belt roller 51, and rotatably supports the shaft 51*a*. The plate 65 is provided near an end of the shaft 51*a* in the housing 1*a*, and includes a guide hole 64. An upper end of the guide hole 64 is where the shaft 51*a* is positioned during a normal printing shown in FIG. 2. The guide hole 64 extends obliquely downward towards the right from the upper end as a part of an arc centered on the shaft 52*a* of the belt roller 52. Each end of the shaft 51*a* is movably positioned inside a guide hole 64.

The connecting member 63 is made of wire, for example. One end of the connecting member is fixed to an upper end of the ring 62. The other end of the connecting member 63 is fixed to and rolled around the shaft 61*a* of the rotation member 61. During the state illustrated in FIG. 4A, that is, during normal printing, load is applied clockwise to the shaft 61*a* of the rotation member 61 by a gear, a clutch spring, or the like, so as to prevent the connecting member 63 from unrolling.

Figure 4A:
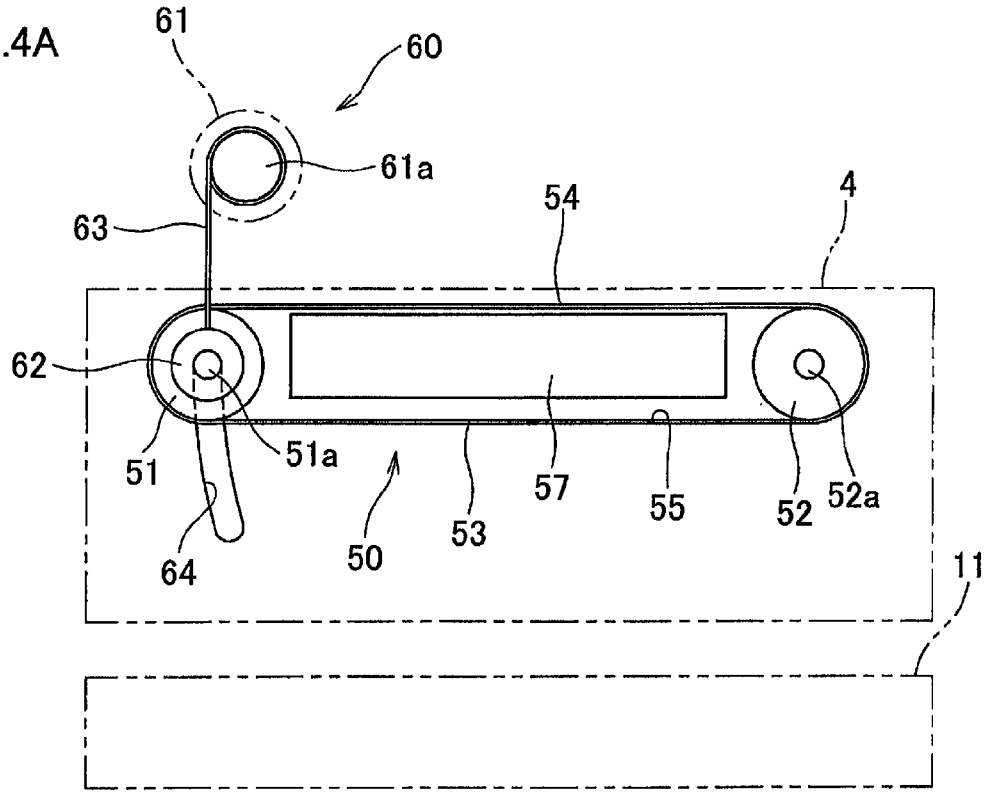
FIGS. 4A and 4B are side views illustrating a movement of a belt roller.
Figure 4B:
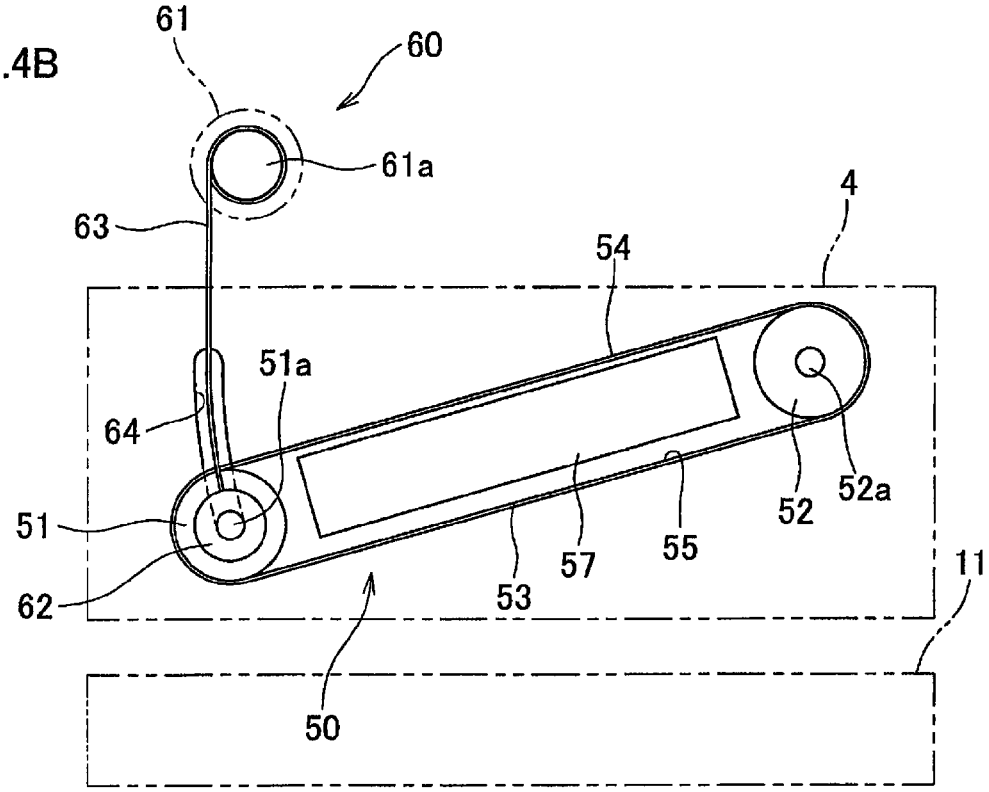

In the mean time, when the sheet P stops between the inkjet heads 2 and the conveyor surface 54, the rotation member 61 rotates counterclockwise in FIG. 4A in response to an operation by a user, causing the connecting member 63 to unroll from the shaft 61*a*. Accordingly, the ring 62 and the shaft 51*a* move obliquely downward to the right along the guide hole 64, and stop at a lower end of the guide hole 64, as illustrated in FIG. 4B. At this time, the two fans 57 and 58, and the conveyor belt 53 tilt downwardly to the left. This creates a large space between the inkjet heads 2 and the conveyor belt 53, allowing the stopped sheet P to be easily removed.

The following describes the control unit 100. The control unit 100 is configured with a general-purpose personal computer, for example. The computer stores therein hardware such as a Central Processing Unit (CPU), a Read Only Memory (ROM), a Random Access Memory (RAM), and a hard-disk. The hard-disk stores therein various kinds of software including a program for controlling an operation of the printer 1. Later-described members 101 to 108 (see FIG. 5) are combinations of these kinds of hardware and software.

Figure 5:
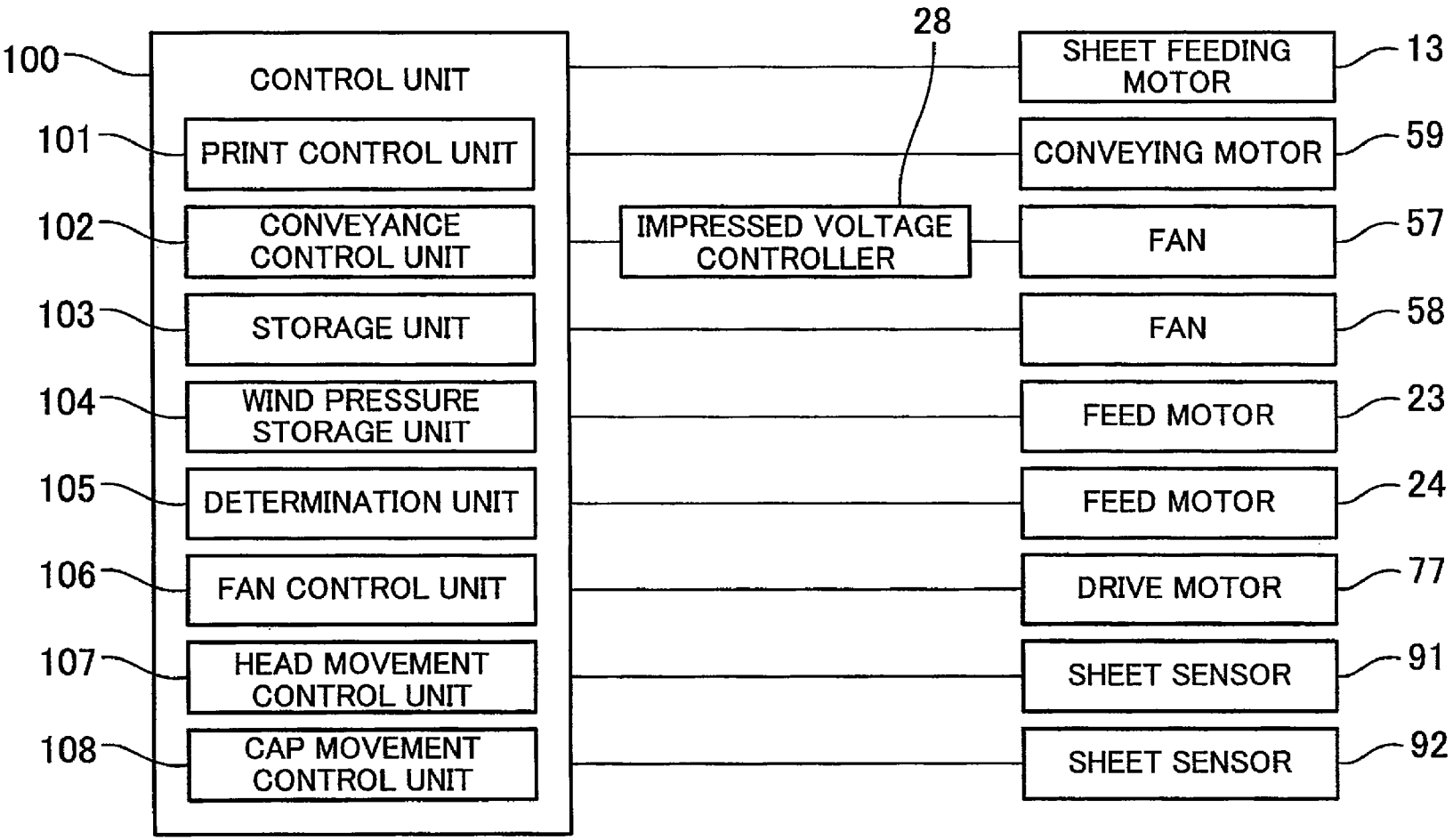
FIG. 5 is a block diagram illustrating a schematic structure of a control unit.

FIG. 5 is a block diagram illustrating a schematic configuration of the control unit 100. The control unit 100 includes: a print control unit 101, a conveyance control unit 102; a storage unit 103; a wind pressure storage unit 104; a determination unit 105; a fan control unit 106; a head movement control unit 107; and a cap-movement control unit 108. The control unit 100 is connected to the impressed voltage controller 28. The control unit 100 and the impressed voltage controller 28 form a controller. The print control unit 101 controls ink ejection from each of the inkjet heads 2 so as to form an image on a desired part of a sheet P, after a predetermined period of time has elapsed after the sheet sensor 91 has detected the leading end of the sheet P, i.e. after a detection signal has been sent to the control unit 100.

The conveyance control unit 102 controls the sheet feeding motor 13, the conveying motor 59, and the feed motors 23 and 24, to convey a sheet P from the sheet feed unit 10 to the sheet discharge unit 15. Further, when the determination unit 105 determines that the sheet P is not correctly conveyed, the conveyance control unit 102 controls the sheet feeding motor 13, the conveying motor 59, and the feed motors 23 and 24, to stop conveying the sheet P.

The storage unit 103 stores various types of sheets selectable by a user. The information of the type of a sheet is included in printing data to be sent to the control unit 100. A type of a sheet is a weight of the sheet per unit area, as described above. Thus, the storage unit 103 stores a weight per unit area of a sheet such as plain paper or a postcard. The wind pressure storage unit 104 stores a value of wind pressure according to each type of sheet. The determination unit 105 detects a type of a sheet used in the current printing, based on the types of sheets stored in the storage unit 103. Hence in the embodiment, the storage unit 103 and the determination unit 105 configure a detector. When a detection signal from the sheet sensor 92 is not sent to the control unit 100 within a predetermined period of time after a detection signal from the sheet sensor 91 has been sent to the control unit 100, the determination unit 105 determines that the sheet P is not correctly conveyed. Examples of this include a case where a sheet P jams between the inkjet heads 2 and the conveyor surface 54. Meanwhile, when a detection signal from the sheet sensor 92 is sent to the control unit 100 within a predetermined period of time after a detection signal from the sheet sensor 91 has been sent to the control unit 100, the determination unit 105 determines that a sheet P is correctly conveyed.

When the sheet sensor 91 detects a sheet P, that is, when the sheet P is conveyed by the belt conveyor 50, the fan control unit 106 controls the fans 57 and 58 so as to cause air suction through holes 56 facing the fans 57 and 58. Further, when the sheet P is not correctly conveyed and the conveyance of the sheet P stops under control of the conveyance control unit 102, the fan control unit 106 controls the fan 58 to cause air suction through holes 56*b*, and controls the fan 57 to cause air exhaust through holes 56*a*. Further, the fan control unit 106 controls the fan 57 via the impressed voltage controller 28 to adjust the amount of air exhausted through holes 56*a* according to the type of the sheet detected by the determination unit 150, so that a wind pressure stored in the wind pressure storage unit 104 according to the detected type of sheets is applied to the sheet P.

The head movement control unit 107 controls the head-moving mechanism so that the four inkjet heads 2 move from the printing position to the withdrawal position before air is exhausted through the holes 56*a* after the conveyance of the sheet P by the belt conveyor has stopped; i.e., before a wind pressure is applied to the sheet P. The cap movement control unit 108 controls the cap moving mechanism 72, that is, a drive motor 77, so that the four caps 71 move from the withdrawal position to the capping position, before air is exhausted through the holes 56*a* after the head movement control unit 107 has moved the four inkjet heads 2 to the withdrawal position.

The following describes an operation carried out during a normal printing operation, and an operation carried out before a sheet P is removed when the sheet P stops between the inkjet heads 2 and the conveyor surface 54, with reference to FIG. 6. FIG. 6 is an explanatory diagram describing an operation carried out when conveyance of a sheet P is stopped in the inkjet printer of the embodiment. Note that FIG. 6 is a briefing diagram and a cross-sectional view taken along the VI-VI line of FIG. 2.

When printing data is sent from a PC (personal computer) or the like to the control unit 100, the conveyance control unit 102 drives the sheet feeding motor 13 to cause a sheet P to be sent out from the sheet feed cassette 11 to the belt conveyor 50 through the conveyance guide 17. In this operation, the determination unit 105 detects the type of the sheet selected by a user.

Next, the conveyance control unit 102 controls the conveying motor 59 to cause the sheet P to be conveyed in the conveyance direction A. When the sheet sensor 91 detects the leading end of the sheet P, the fan control unit 106 drives the fans 57 and 58 to cause the sheet P being conveyed on the conveyor belt 53 to be absorbed onto the conveyor surface 54.

Next, the print control unit 101 controls each of the inkjet heads 2 to eject ink after a predetermined period of time after the sheet sensor 91 has detected the leading end of the sheet P, that is, the print control unit 101 controls each of the inkjet heads 2 to eject ink when the sheet P passes through the area where the sheet P faces the inkjet heads 2. An image is thus formed on a desired part of the sheet P.

Next, the conveyance control unit 102 controls the sheet feed motors 23 and 24 to cause the sheet P with an image printed thereon to be discharged from the conveyor belt 53 into the sheet discharge unit 15, through the conveyance guide 18. Thus, a printing operation as described above is carried out unless for example the sheet P is not jammed.

However, for instance, the leading end of the sheet P absorbed onto the conveyor surface 54 is curled, and thus the leading end of the sheet P contacts the bottom of the most downstream inkjet head 2 in the conveyance direction A during printing, causing the sheet P to jam between the ejection surface 2*a* and the conveyor surface 54. In such case, the sheet sensor 92 does not detect the leading end within a predetermined period of time after the sheet sensor 91 has detected the leading end of the sheet P. Thus, the conveyance control unit 102 controls the sheet feeding motor 13 and the conveying motor 59 to stop conveying the sheet P. The following describes an operation carried out before the stopped sheet P is removed.

Figure 6A:
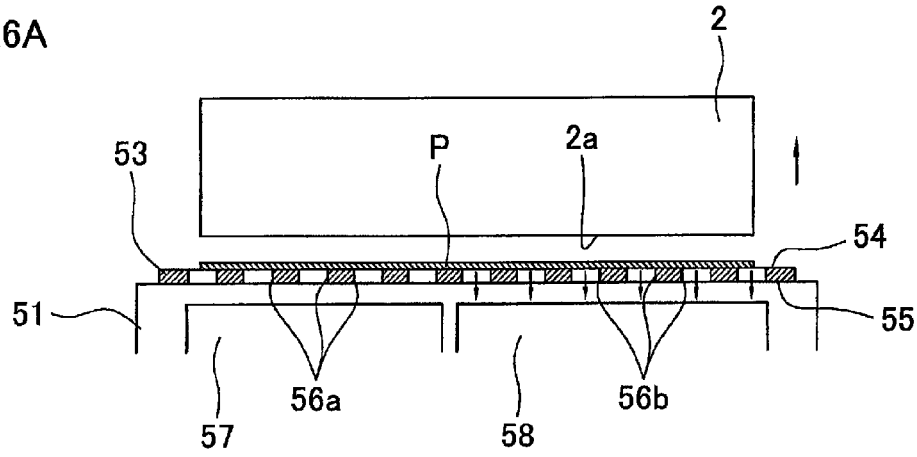
FIGS. 6A, 6B, and 6C are side views illustrating operations of the inkjet printer of the embodiment when conveyance of a sheet is stopped.
Figure 6B:
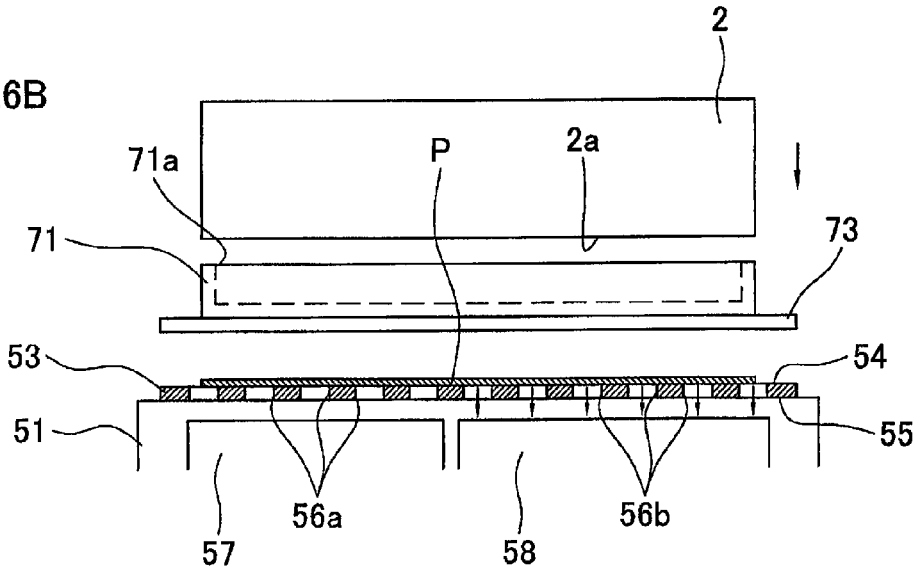
Figure 6C:
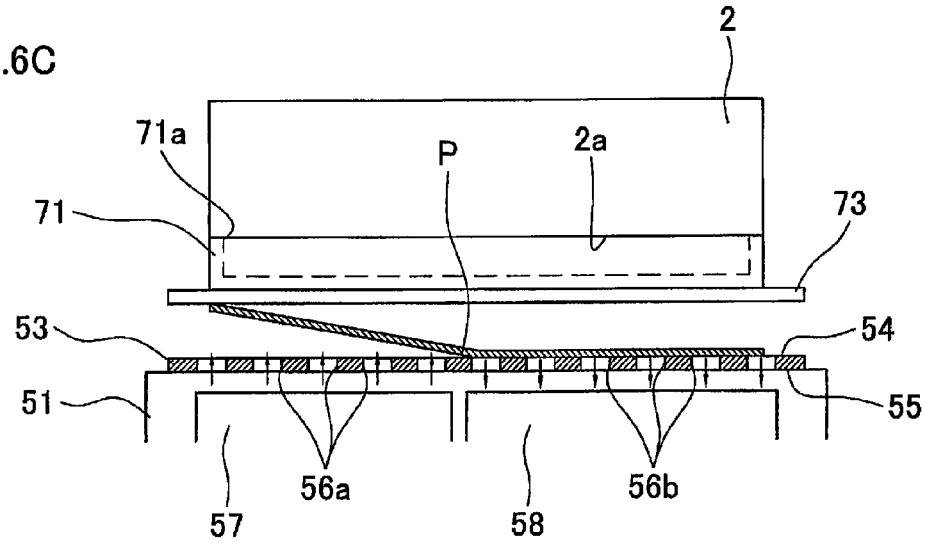

Next, the head movement control unit 107 controls the head-moving mechanism so that the four inkjet heads 2 move from the printing position to the withdrawal position as illustrated in FIGS. 6A and 6B. Then, the cap movement control unit 108 controls the drive motor 77 so that the four caps 71 move form the withdrawal position to the capping position, as illustrated in FIG. 6B. Afterwards, the head movement control unit 107 controls the head-moving mechanism to bring down the four inkjet heads 2 to a position slightly below the withdrawal position, so that the ejection surfaces 2*a* contact the caps 71, as illustrated in FIG. 6C. Thus, each of the ejection surfaces 2*a* is covered with a corresponding cap 71. Hence, air is exhausted through the holes 56*a* after the caps 71 have covered the ejection surfaces 2*a*, as described below. This prevents foreign materials such as paper dust from adhering to the ejection surfaces 2*a*.

Next, the fan control unit 106 controls the fan 57 to cause air suction only through the holes 56*a* facing the fan 57, among the holes 56*a* and 56*b* facing the sheet P. In this operation, the fan control unit 106 controls the fan 57 via the impressed voltage controller 28 to adjust the amount of air exhausted through holes 56*a*, so that the wind pressure according to the type of the sheet detected by the determination unit 105 (For example, 70 to 90 g/cm$^2$ for plain paper, and approximately 210 g/cm$^2$ for post card) is applied to the sheet P. Note that the fan control unit 106 controls the fan 58 so as to remain driven since before the conveyance of the sheet P stops. That is, the fan 58 is controlled to cause air suction only through the holes 56*b* facing the fan 58, among the holes 56*a* and 56*b* facing the sheet P. By doing this, as illustrated in FIG. 6C, a part of the sheet P facing the fan 57 is lifted to separate from the conveyor surface 54, and another part of the sheet P facing the fan 58 is absorbed onto the conveyor surface 54.

Next, the user operates the rotation member 61 to bring down the belt roller 51, as illustrated in FIG. 4B. Then, the user opens the door 4, and removes the sheet P from the large space created between the inkjet head 2 and the conveyor belt 53. Note that when the sheet P is easily removable without operating the rotation member 61, the user may simply open the door 4 and remove the sheet P, without operating the rotation member 61.

According to the inkjet printer 1 of the present embodiment, air is exhausted through the holes 56*a*, that is, a wind pressure is applied to the sheet P. Thus, the sheet P is lifted from the conveyor surface 54 even if the sheet P stops between the conveyor surface 54 and the inkjet heads 2 for some reason such as a sheet P jams between the inkjet heads 2 and the conveyor surface 54. Thus, the sheet P is easily peeled from the conveyor surface 54. Accordingly, the sheet P is easily removed.

Further, when the sheet P is stopped between the inkjet heads 2 and the conveyor surface 54, air is exhausted only through the holes 56*a* facing the fan 57 among the holes 56*a* and 56*b* facing the sheet P. This prevents the sheet P from being entirely lifted from the conveyor surface 54 and moving somewhere from the conveyor belt 53. Thus, a user is able to easily find and remove the sheet P.

Further, when the sheet P is stopped between the inkjet heads 2 and the conveyor surface 54, air is sucked only through the holes 56*b* facing the fan 58 among the holes 56*a* and 56*b* facing the sheet P. This surely prevents the sheet P from being entirely lifted from the conveyor surface 54, and moving somewhere from the conveyor belt 53.

Further, the fan 58 is controlled so that air is sucked through the holes 56*b* facing the fan 58 when the sheet P is conveyed by the belt conveyor 50. This allows the sheet P to be absorbed onto the conveyor surface 54 when conveyed.

Further, the fan 57 is controlled so that air is sucked through the holes 56*a* facing the fan 57 when the sheet P is conveyed by the belt conveyor 50. Thus, the holes 56*a* are utilized for both lifting the sheet P from the conveyor surface 54, and absorbing the sheet P to the conveyor surface 54 while the sheet P is being conveyed.

The housing 1*b* has the door 4 on a wall near the fan 57, the wall facing the holes 56*a* which can face the fan 57. Thus, an area of the sheet P relatively close to the door 4 is lifted from the conveyor surface 54 with the fan 57. Thus, a user is able to grab and remove the sheet P from the conveyor surface 54 easily.

Further, the amount of air exhausted through the holes 56*a* is adjusted according to the type of the sheet P, in order to apply a desired wind pressure to the sheet P. Thus, a sheet P is lifted from the conveyor surface 54 even when the sheet P is a postcard or the like thicker than plain paper. Thus, the sheet P is effectively peeled from the conveyor surface 54.

Figure 7:
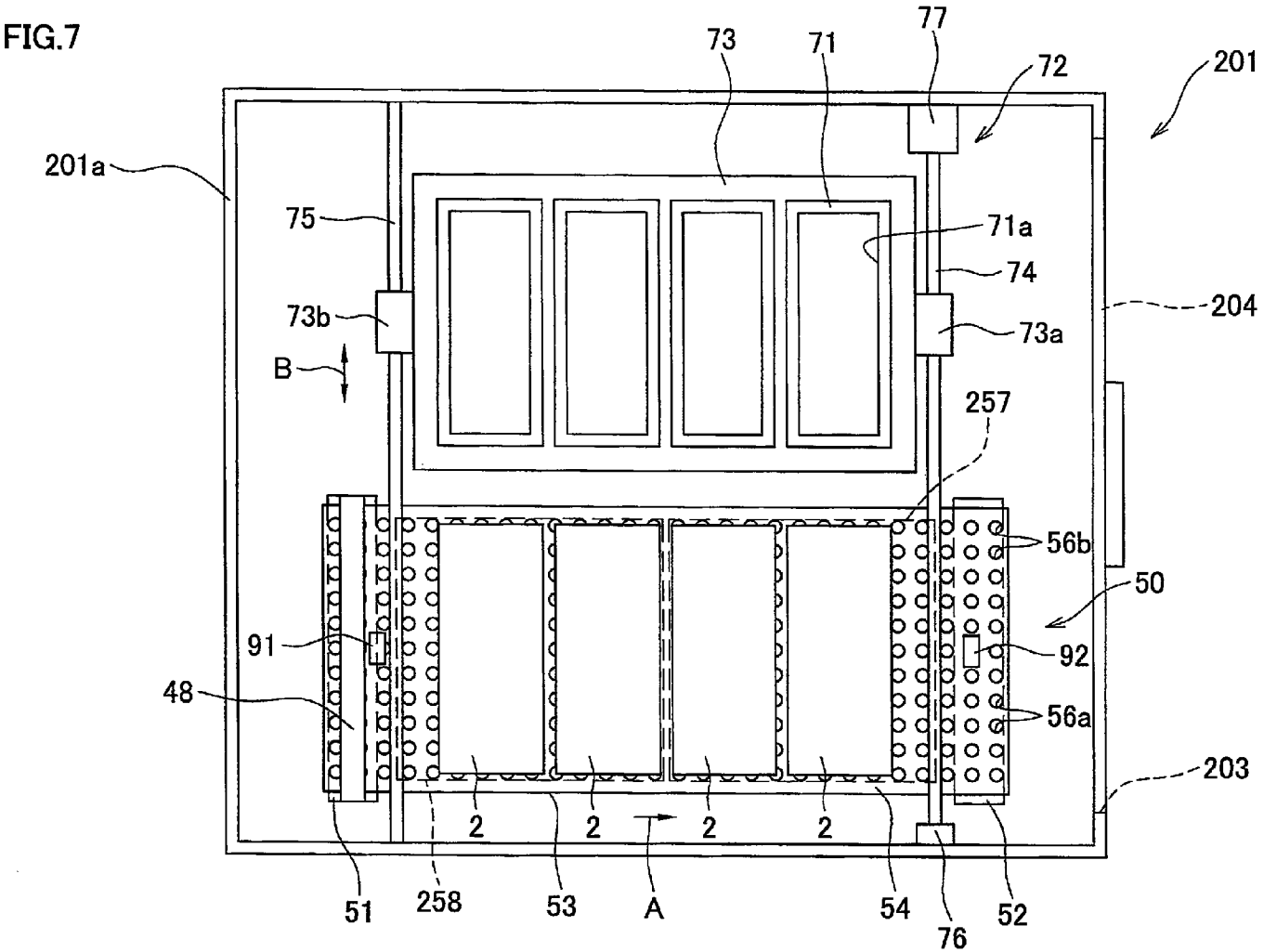
FIG. 7 is a schematic plan view of an internal structure of an inkjet printer of a second embodiment of the present invention.

The following describes a second embodiment of the present invention. FIG. 7 is a schematic plan view of an internal structure of an inkjet printer of a second embodiment of the present invention. An inkjet printer 201 of the present embodiment has the same structure as the inkjet printer 1 of the first embodiment except different arrangements of two fans 257 and 258, an opening 203, and a door 204. Note that the members same as those in the first embodiment will be denoted by the same reference numbers, without specific descriptions thereof.

The two fans 257 and 258 of the present embodiment are aligned adjacent to each other in the conveyance direction A, as illustrated in FIG. 7. The fan 257 is positioned more downstream than the fan 258 in the conveyance direction A. The fan 257 serving as an exhauster corresponds to the fan 57 of the first embodiment. The fan 258 serving as a suction device corresponds to the fan 58 of the first embodiment. The fans 257 and 258 respectively perform substantially the same control as the fans 57 and 58 of the first embodiment. In other words, among a plurality of holes 56 formed on the conveyor belt 53, the fan 257 causes air suction and exhaust through holes 56 facing the fan 257 between the inkjet heads 2 and the fan 257. The fan 258 causes air suction through holes 56 facing the fan 258 between the inkjet heads 2 and the fan 258, among the plurality of holes 56 formed on the conveyor belt 53.

A housing 201*a* of the inkjet printer 201 includes an opening 203 and a door 204 fitted into the opening 203. The door 204 is capable of opening and closing about a horizontal axis at its lower end in the vertical direction. The opening 203 and the door 204 face the belt conveyor 50 in the conveyance direction A. Further, the opening 203 and the door 204 are provided at a position facing the holes 56 on a wall closer to the holes 56 used for air exhaust by the fan 257, among two walls of the housing 201*a* facing one another in the conveyance direction A (the wall on the right in FIG. 7).

In the structure, when a sheet P stops between the inkjet heads 2 and the conveyance surface 54, a wind pressure applied to a sheet P lifts a part of the sheet P facing the fan 257 from the conveyance surface 54, as described in the first embodiment. Thus, the same effect as the first embodiment is achieved. The opening 203 and the door 204 are provided onto a wall of the housing 204*a* facing the fan 257 and close to the fan 257, the wall facing the holes 56 provided to a part of the conveyor surface 54 able to face the fan 257. Thus, an area relatively close to the door 204 on the sheet P is lifted from the conveyor surface 54 by the fan 257. This enables a user to grab and remove the sheet P from the conveyor surface 54 easily.

The holes 56 of each of the above embodiments formed on the conveyor belt 53 are plane circle; however, shapes of the holes 56 are not limited to this. The holes 56, for example, may have plane rectangular shapes longer in the conveyance direction A. Further, there may be only one hole provided. Although the embodiments have two fans 57 and 58, and two fans 257 and 258, respectively, each embodiment may be provided with only one fan. In such case, one or more holes may be provided only at a position able to face the fan 57, in the first embodiment.

Further, the conveyor surface may be adhesive. No fan for absorbing a sheet P on the conveyor surface and no hole for air suction would be necessary in this case. Further, the openings 3*a* and 203, and the doors 4 and 204 may be provided onto a wall other than a wall of the housings 1*a* and 201*a*.

A fan may be provided to allow air exhaust through every hole facing a stopped sheet P. Specifically, such fan as facing the entire four ejection surfaces 2*a* may be provided. Further, caps 71 and the cap moving mechanism 72 are not necessarily provided. The roller moving mechanisms 60 are not necessarily provided. A sheet P is conveyed by the belt conveyor 50 in the above embodiments; however, a conveyor to convey a sheet is not limited to the belt conveyor 50. The conveyor may be a drum conveyor which conveys a sheet P on a rotatable drum.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus comprising:

a conveyer which has one or more holes penetrating from a first surface to a second surface thereof and which conveyer conveys, in a conveyance direction, a recording medium supported on the first surface;

a recording unit which is at such a position as to face the first surface and which recording unit records an image on a recording medium while the recording medium is conveyed by the conveyer;

an exhauster capable of causing air to exhaust through the one or more holes so that an airstream in the one or more holes is directed from the second surface to the first surface; and a controller which controls the exhauster to cause air to exhaust through at least one medium-facing hole facing a recording medium and being included in the one or more holes formed in the conveyer.

2. The recording apparatus according to claim 1, wherein the controller controls the exhauster so as to, when a recording medium between the first surface and the recording unit is stopped from being conveyed by the conveyer, cause air to exhaust through at least one medium-facing hole.

3. The recording apparatus according to claim 1 wherein the controller controls the exhauster so as to, when a recording medium between the first surface and the recording unit is stopped from being conveyed by the conveyer, cause air to exhaust only through an exhausting hole group including one or more but not all medium-facing holes included in the one or more holes formed in the conveyor.

4. The recording apparatus according to claim 3, wherein the exhausting hole group includes holes scattered in the conveyance direction.

5. The recording apparatus according to claim 3 further comprising a suction device capable of causing air suction through a suction hole group including one or more holes out of the one or more holes formed in the conveyer so that airstream in the one or more holes included in the suction hole group is directed from the first surface to the second surface, wherein the controller controls the suction device so as to, when a recording medium between the first surface and the recording unit is stopped from being conveyed by the conveyer, cause air suction from one or more medium-facing holes other than the one or more holes included in the exhausting hole group.

6. The recording apparatus according to claim 5, wherein the exhauster is further capable of causing air suction through the suction hole group so that the airstream in the one or more holes included in the suction hole group is directed from the first surface to the second surface, and wherein the controller controls the exhauster or the suction device so as to, when a recording medium is conveyed by the conveyer, cause air suction through at least one medium-facing hole.

7. The recording apparatus according to claim 3 further comprising a housing which contains the conveyer, the recording unit, and the exhauster, and which housing has a door in one wall out of two walls facing each other in the direction perpendicular to the conveyance direction, the one wall being closer to the exhausting hole group than the other wall is, the door being at such a position so as to face the exhausting hole group.

8. The recording apparatus according to claim 3 further comprising a housing which contains the conveyer, the recording unit, and the exhauster, and which housing has a door in one wall out of two walls facing each other in the conveyance direction, the one wall being closer to the exhausting hole group than the other wall, the door being at such a position so as to face the exhausting hole group.

9. The recording apparatus according to claim 1, wherein the controller controls the suction device so as to, when a recording medium is conveyed by the conveyer, cause air suction through at least one medium-facing hole.

10. The recording apparatus according to claim 1 further comprising a detector which detects a type of a recording medium, wherein the controller controls the exhauster so as to, depending on the type of a recording medium detected by the detector, adjust an exhaust volume from the at least one medium-facing hole.

11. The recording apparatus according to claim 10, wherein the type of a recording medium is detected by a weight of the recording medium per unit area.

12. The recording apparatus according to claim 1, wherein the recording unit is an inkjet head having an ejection surface on which a plurality of nozzles are formed to eject ink on a recording medium, wherein the recording apparatus further comprises: a cap for covering the ejection surface; and a movement mechanism which moves the cap between a capping position and a withdrawal position, the capping position being such a position that the cap covers the ejection surface, the withdrawal position being such a position that the cap does not cover the ejection surface, and wherein the controller controls the movement mechanism so that the cap moves to the capping position prior to an exhaust from one or more holes.

13. The recording apparatus according to claim 1 further comprising a movement mechanism capable of moving either of the recording unit or the conveyer so that a distance between a recording surface of the recording unit and the first surface is larger than when an image is formed on a recording medium, the recording surface facing the first surface.

14. The recording apparatus according to claim 1 further comprising:

a detector which detects a type of a recording medium; and a wind pressure storage which stores therein a wind pressure value corresponding to each of types of the recording medium, wherein the controller controls the exhauster so that, depending on the type of a recording medium detected by the detector, the recording medium is given a wind pressure whose value is stored in the wind pressure storage.

15. The recording apparatus according to claim 1, wherein the first surface is adhesive.

16. The recording apparatus according to claim 1 further comprising:

a first sensor provided upstream of the recording unit in the conveyance direction so as to face the conveyer and which first sensor is capable of detecting a leading end of a recording medium; and a second sensor provided downstream of the recording unit in the conveyance direction so as to face the conveyer and which second sensor is capable of detecting a leading end of a recording medium, wherein the controller controls the conveyer so that, when the second sensor does not detect a leading end of a recording medium within a predetermined time after the first sensor detects the leading end, the recording medium is stopped from being conveyed.

17. The recording apparatus according to claim 16, wherein the controller controls the exhauster cause air to exhaust through at least one medium-facing hole, when a recording medium between the first surface and the recording unit is stopped from being conveyed by the conveyer.

18. The recording apparatus according to claim 16 wherein the controller controls the exhauster so as to, when a recording medium between the first surface and the recording unit is stopped from being conveyed by the conveyer, cause air to exhaust only through an exhausting hole group including one or more but not all medium-facing holes included in the one or more holes formed in the conveyer.

19. The recording apparatus according to claim 18 further comprising a suction device capable of causing air suction through a suction hole group including one or more holes out of the one or more holes formed in the conveyer so that airstream in the one or more holes included in the suction group is directed from the first surface to the second surface, wherein the controller controls the suction device so as to, when a recording medium between the first surface and the recording unit is stopped from being conveyed by the conveyer, cause air suction through one or more medium-facing holes other than the one or more holes included in the exhausting hole group.

20. The recording apparatus according to claim 1, wherein the conveyer has a pair of belt rollers, an endless belt looped around the belt rollers, and a conveying motor providing a drive power to rotate the belt rollers.

* * * * *